US009223288B2

(12) United States Patent
Yang et al.

(10) Patent No.: US 9,223,288 B2
(45) Date of Patent: Dec. 29, 2015

(54) WASTE TONER COLLECTING CONTAINER AND PROCESS UNIT

(75) Inventors: Chuanyi Yang, Shanghai (CN); Hongjie Tan, Shanghai (CN); Junlin Cai, Shanghai (CN); Fei Zhang, Shanghai (CN); Fawei Chen, Shanghai (CN)

(73) Assignee: RICOH COMPANY, LTD., Tokyo (JP)

( * ) Notice: Subject to any disclaimer, the term of this patent is extended or adjusted under 35 U.S.C. 154(b) by 101 days.

(21) Appl. No.: 13/590,473

(22) Filed: Aug. 21, 2012

(65) Prior Publication Data

US 2013/0051882 A1 Feb. 28, 2013

(30) Foreign Application Priority Data

Aug. 25, 2011 (CN) ..... 2011 1 0247357
Aug. 25, 2011 (CN) ..... 2011 2 0313918 U

(51) Int. Cl.
*G03G 21/12* (2006.01)
*G03G 21/18* (2006.01)

(52) U.S. Cl.
CPC ..... *G03G 21/1814* (2013.01); *G03G 21/12* (2013.01)

(58) Field of Classification Search
CPC ..... G03G 21/12; G03G 21/10; G03G 21/00
USPC ..... 399/99, 107, 113, 264, 343, 358, 360
See application file for complete search history.

(56) References Cited

U.S. PATENT DOCUMENTS 6,298,202 B1 10/2001 Fushiya et al.
2005/0036810 A1* 2/2005 Murakami et al. ..... 399/360
2006/0159497 A1* 7/2006 Choi et al. ..... 399/358
2006/0193648 A1* 8/2006 Kadowaki et al. ..... 399/13
2009/0097879 A1* 4/2009 Nagashima et al. ..... 399/120
2010/0215407 A1* 8/2010 Funada et al. ..... 399/258

(Continued)

FOREIGN PATENT DOCUMENTS

JP 04000484 A * 1/1992 ..... G03G 21/00
JP 05-323837 12/1993
JP 2001-117470 4/2001

(Continued)

OTHER PUBLICATIONS

U.S. Appl. No. 13/592,774, filed Aug. 23, 2012, Tong et al.

(Continued)

*Primary Examiner* — Benjamin Schmitt
*Assistant Examiner* — Matthew Miller
(74) *Attorney, Agent, or Firm* — Oblon, McClelland, Maier & Neustadt, L.L.P.

(57) ABSTRACT

Disclosed is a waste toner collecting container used in an image forming device for collecting waste toner and a process unit having the waste toner collecting container. An assembly of a development unit and the photoreceptor unit is fixedly connected to the waste toner collecting container. The development unit is configured to supply toner to a photoreceptor in the photoreceptor unit. The photoreceptor unit is configured to form a toner image on an outer surface of the photoreceptor, and to have a cleaning component used for removing the waste toner remaining on the outer surface of the photoreceptor after the toner image is transferred to a recording medium. A waste toner discharging outlet is disposed on a top wall of the waste toner collecting container, far away from the photoreceptor, and is disposed at an end of the top wall along an axial direction of the photoreceptor.

19 Claims, 4 Drawing Sheets

(56) References Cited

U.S. PATENT DOCUMENTS

| | | | | |
|---|---|---|---|---|
| 2010/0232816 | A1 | 9/2010 | Tan et al. | |
| 2011/0182639 | A1 * | 7/2011 | Kim et al. | 399/358 |

FOREIGN PATENT DOCUMENTS

| | | | |
|---|---|---|---|
| JP | 2001117470 | A * | 4/2001 |
| JP | 2009-008817 | | 1/2009 |
| JP | 2010-085631 | | 4/2010 |

OTHER PUBLICATIONS

Office Action issued Mar. 4, 2014, in Russian Patent Application No. 2012136214, filed Aug. 23, 2012 (w/English language translation).

* cited by examiner

WASTE TONER COLLECTING CONTAINER AND PROCESS UNIT

BACKGROUND OF THE INVENTION

1. Field of the Invention

The present invention relates to a waste toner collecting container used in an image forming device and a process unit including the waste toner collecting container.

2. Description of the Related Art

In recent years, an all-in-one process unit including a development unit, a photoreceptor unit, a waste toner collecting container, and other components have been used in an electrographic image forming device in response to the need for downsizing the device. In this kind of process unit, the development unit supplies toner to a photoreceptor in the photoreceptor unit for development.

In conventional techniques, the development unit comprises a development roller, a supply roller, a development sheet, a toner cartridge (also called a "toner box"), etc.; the photoreceptor unit comprises a photoreceptor, a charged component, a cleaning component, etc. The photoreceptor unit supplies the toner in the toner cartridge to the development roller when the image forming device works. The toner is attached to the surface of the development roller under action of an electrostatic force, forms a thin toner layer with uniform thickness by the development sheet, and is friction-charged. Moreover, in the photoreceptor unit, the surface of the photoreceptor which is rotationally driven touches the charged component. The charged component outputs an electrical voltage whose polarity is the same with that of the toner so as to cause the surface of the photoreceptor to be charged uniformly. The charged surface of the photoreceptor is scanned by a laser so that an electrostatic latent image is generated on the surface of the photoreceptor. The charged toner on the development roller in the development unit is transferred to the photoreceptor surface where the electrostatic latent image is generated so that a toner image is formed on the surface of the photoreceptor.

When a piece of recording paper passes through a transfer position between the photoreceptor and a transfer roller, the toner image on the surface of the photoreceptor is transferred to the recoding paper by a transfer bias applied to the transfer roller. Furthermore, after the toner image is transferred to the recoding paper, the toner remaining on the photoreceptor, which is not transferred to the paper, is removed from the surface of the photoreceptor by the cleaning component to serve as waste toner; the waste toner is collected into a waste toner container. After that, the photoreceptor on which the toner that was not transferred to the recording paper has been removed is charged again by the charged component so as to repeatedly carry out the above described processing.

Years ago, once the toner in the toner cartridge, serving as developer was used-up, it was necessary to entirely replace the process unit. In recent years, in order to decrease cost in use, a method of preserving (not directly throwing away) a used process unit has been adopted; that is, components, containers, and the like in the used process unit are cleaned, and then the used process unit is recycled. In the recycling process, it is necessary to discharge the waste toner from the waste toner collecting container, and to clean the waste toner collecting container. However, in order to discharge the waste toner from the waste toner collecting container, it is often necessary to take out the photoreceptor, the charged component, and the cleaning component from the used process unit in order, and then to discharge the waste toner from the waste toner collecting container. This kind of operation not only is inconvenient but also may cause the waste toner to be scattered when the waste toner is discharged from the waste toner collecting container. As a result, other components in the image forming device may become contaminated, and the reusability of the used process unit may be decreased.

In the conventional techniques, a few techniques have been proposed to solve the above described problem. For example, in the following cited reference No. 1, there is a technical proposal in which plural outlets for discharging waste toner are opened at the central portion of the top of a waste toner collecting container along the transverse direction of the waste toner collecting container. When recycling a used process unit, it is not necessary to take out a photoreceptor, a charged component, and a cleaning component from the used process unit. In other words, only by rotating the whole used process unit so as to render the outlets for discharging the waste toner downward, it is possible to discharge the waste toner from the waste toner collecting container via the outlets. As a result, this kind of structure may control the scattering of the waste toner, effectively improve the reusability of the used process unit, and increase the operability of discharging the waste toner.

However, in the above mentioned technical proposal in the cited reference No. 1, since the outlets for discharging the waste toner are opened at the central portion of the top of the waster toner collecting container, the waste toner may enter the waste toner collecting container as the photoreceptor rotates so that in the waste toner collecting container, the waste toner may be distributed along the axial direction of the photoreceptor. As a result, if the outlets for discharging the waste toner are only opened at the central portion of the top of the waste toner collection container, then a problem that the waste toner cannot be discharged sufficiently may occur. For that, a user needs to swing the process unit right and left so as to cause the waste toner to be discharged as much as possible via the outlets located at the central portion of the top of the waste toner collection container; this is very inconvenient for the user. In addition, since the waste toner itself is cohesive, in order to sufficiently discharge the waste toner, the user sometimes needs to strongly hit the waste toner collecting container. However, this may cause the waste toner to be scattered, and other components in the image forming device may become contaminated. In addition, the quality of the formed image may worsen, and the waste toner collecting container may be broken due to the hitting.

Cited Reference No. 1: Japanese Patent Application Publication No. 2001-117470

SUMMARY OF THE INVENTION

The present invention is proposed in order to overcome the above described one or more disadvantages of the prior art. The aim of the present invention is to provide a waste toner collecting container used in an image forming device and a process unit including the waste toner collecting container.

According to one aspect of the present invention, there is provided a waste toner collecting container used in an image forming device for collecting waste toner. An assembly of a development unit and the photoreceptor unit is fixedly connected to the waste toner collecting container. The development unit is configured to supply toner to a photoreceptor in the photoreceptor unit. The photoreceptor unit is configured to form a toner image on an outer surface of the photoreceptor, and to have a cleaning component used for removing the waste toner remaining on the outer surface of the photoreceptor after the toner image is transferred to a recording medium. A waste toner discharging outlet is disposed on a top wall of the waste toner collecting container, far away from the photoreceptor, and is disposed at an end of the top wall along an axial direction of the photoreceptor.

Furthermore, in the waste toner collecting container, the assembly further has a drive transmitting mechanism which is disposed on a side of the assembly along the axial direction of the photoreceptor, and is configured to drive respective components of the assembly. The waste toner discharging outlet is located at an end of the top wall, far away from the side where the drive transmitting mechanism is disposed, along the axial direction of the photoreceptor.

Moreover, in the waste toner collecting container, plural reinforcing ribs are disposed on an inner surface of at least one peripheral wall of the waste toner collecting container.

In addition, in the waste toner collecting container, a ratio of a distributional area of the plural reinforcing ribs to a peripheral wall surrounded area of the waste toner collecting container on a cross section perpendicular to the axial direction of the photoreceptor is 10% to 50%.

Also, in the waste toner collecting container, the at least one peripheral wall of the waste toner collecting container is the top wall or a side wall far away from the photoreceptor.

Furthermore, in the waste toner collecting container, the plural reinforcing ribs extend along a direction perpendicular to the axial direction of the photoreceptor.

Moreover, in the waste toner collecting container, a protrusion is disposed on the outer surface of the top wall of the waste toner collecting container, and the waste toner discharging outlet is disposed on the protrusion.

Additionally, in the waste toner collecting container, the height of the protrusion from the outer surface of the top wall of the waste toner collecting container is 3 mm to 8 mm.

According to another aspect of the present invention, there is provided a process unit used in an image forming device. The process unit comprises an assembly of a development unit and a photoreceptor unit; and the above described waste toner collecting container.

Furthermore, in the process unit, a toner filling inlet is disposed at a position on the top wall of the process unit.

According to still another aspect of the present invention, there is provided an image forming device. The image forming device comprises the above described process unit.

DETAILED DESCRIPTION OF THE PREFERRED EMBODIMENTS

Hereinafter, embodiments of the present invention will be concretely described with reference to the drawings. However it should be noted that the same symbols, which are in the specification and the drawings, stand for constructional elements having basically the same function and structure, and repeated explanations for the constructional elements are omitted.

Figure 1:
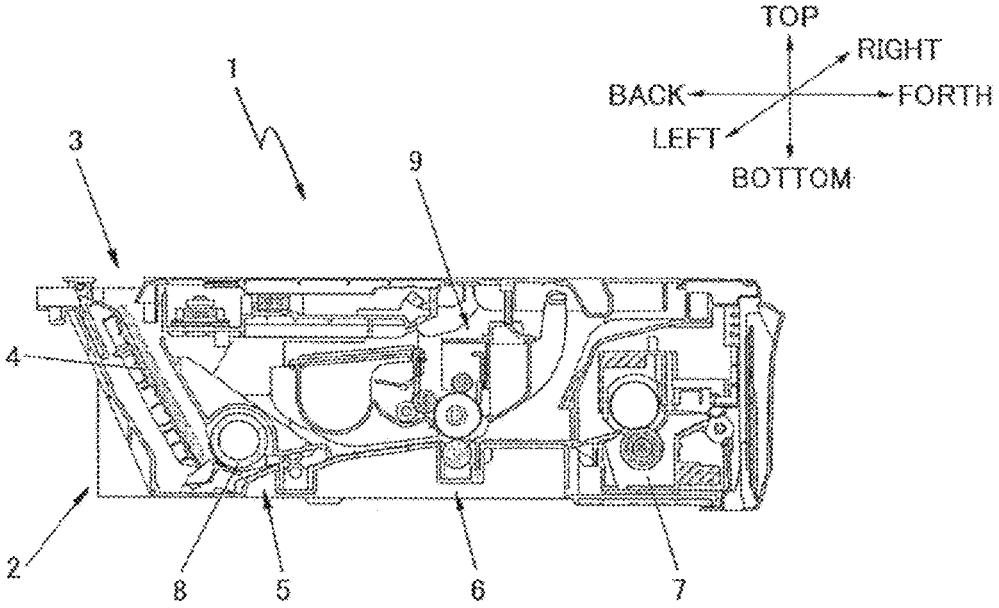
FIG. 1 is a cross-section diagram of an overall structure of a printer according to a first embodiment of the present invention.

Furthermore, it should be noted that in FIG. 1, directions, i.e., top, bottom, left, right, forth, and back, indicated by arrows located at the top right corner refer to those determined on the basis of an observation angle of a person standing near a laser printer 1 serving as an instance of an image forming device. In addition, it should be noted that the following mentioned directions refer to the directions indicated by the arrows located at the top right corner in FIG. 1 unless there is a special statement.

In what follows, a first embodiment of the present invention is concretely described by referring to FIGS. 1 to 7.

<Overall Structure of Printer 1>

FIG. 1 is a cross-section diagram of the overall structure of the printer 1 according to the first embodiment of the present invention.

As shown in FIG. 1, the printer 1 comprises a main body housing 2 and a paper tray 3 installed in the main body housing 2. The paper tray 3 is used for storing stacked recording papers 4. The main body housing 2 includes a paper feed mechanism 5, an image forming mechanism 6, and a fixing mechanism 7. The paper feed mechanism 5 includes a feed-in roller 8 used for feeding the recording papers 4 piece by piece. The paper feed mechanism 5 further includes a pair of resist rollers (not shown in the drawings) disposed in front of the feed-in roller 8. The paired two resist rollers cooperate so as to receive the recording papers 4 fed by the feed-in roller 8, and to send the recording papers 4 to the image forming mechanism 6.

The image forming mechanism 6 includes a process mechanism and a transfer mechanism (not shown in the drawings). The process mechanism includes a process unit 9; the process unit 9 is detachable with respect to the printer 1. For example, when toner serving as developer in the process unit 9 is used-up, a user may take out the used process unit 9 from the printer 1, and install a new process unit 9 in the printer 1.

<Structure of Process Unit 9>

Figure 2:
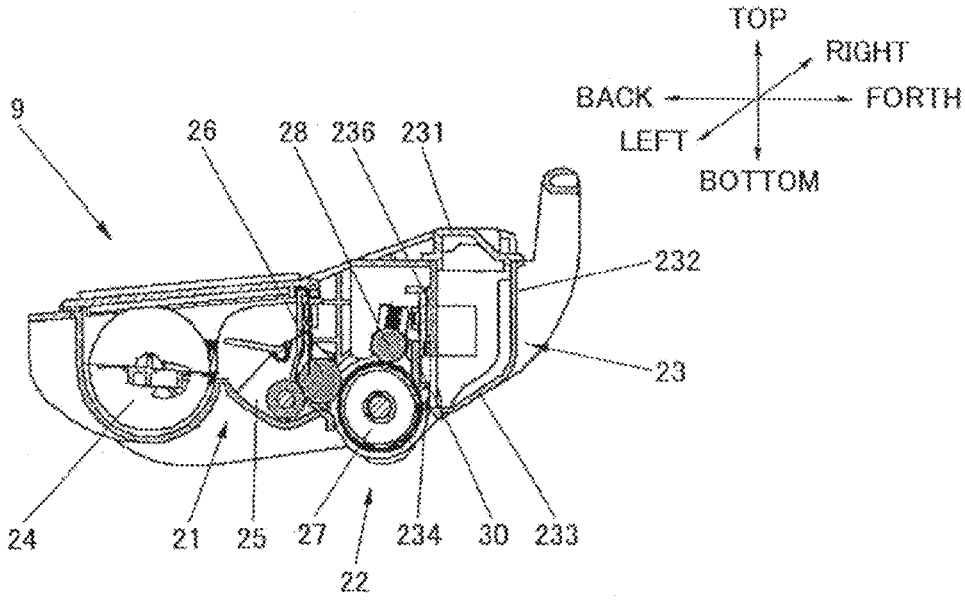
FIG. 2 is a cross-section diagram of an internal structure of a process unit in the printer shown in FIG. 1.

FIG. 2 is a cross-section diagram of the internal structure of the process unit 9 in the printer 1 shown in FIG. 1.

Figure 3:
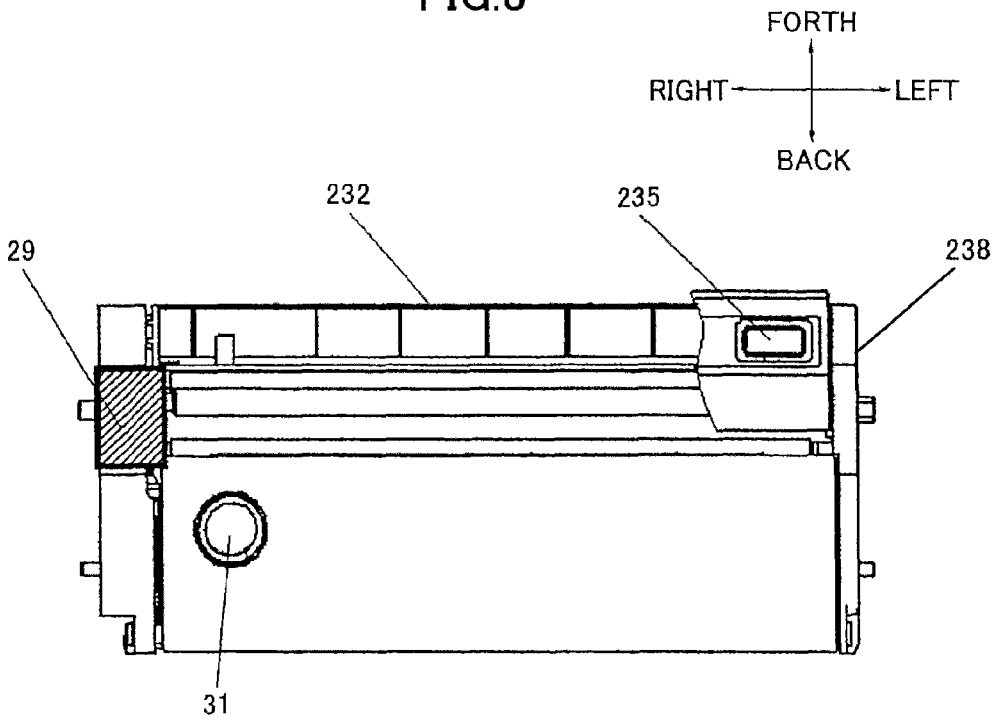
FIG. 3 is a top view of the process unit in the printer shown in FIG. 1.

FIG. 3 is a top view of the process unit 9 in the printer 1 shown in FIG. 1.

As shown in FIG. 2, the process unit 9 comprises an assembly of a development unit 21 and a photoreceptor unit 22 as well as a waste toner collecting container 23 fixedly connected to the assembly. The development unit 21 includes a toner cartridge 24 and a development box 25. The toner cartridge 24 is disposed behind the development box 25 along a nearly horizontal direction. In the development box 25, there is a development roller 26.

Figure 4:
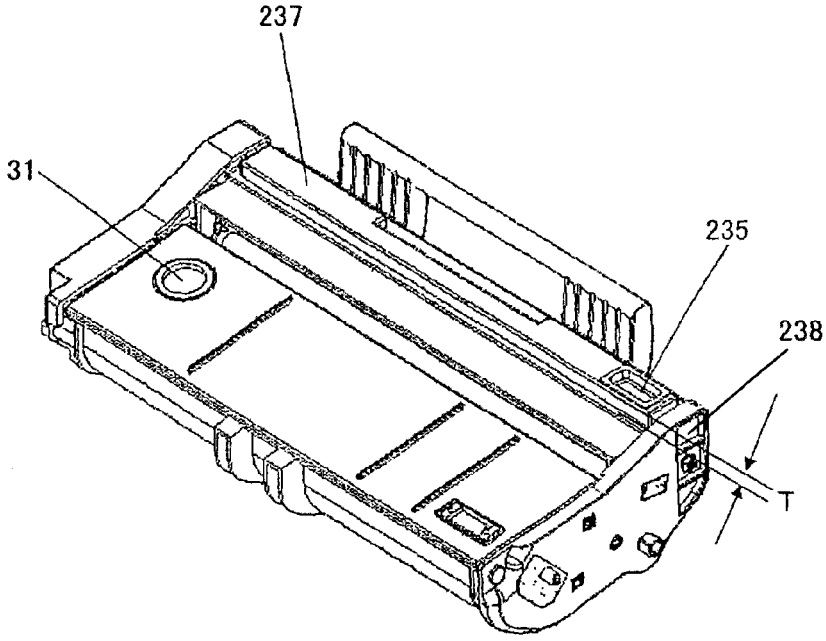
FIG. 4 is a perspective view of the process unit in the printer shown in FIG. 1.

FIG. 4 is a perspective view of the process unit 9 shown in FIG. 2.

As shown in FIGS. 3 and 4, a toner filling inlet 31 is disposed at a position on the outer wall of the process unit 9, corresponding to the position of the toner cartridge 24; the toner filling inlet 31 is used for filling the toner cartridge 24 with toner.

The photoreceptor unit 22 is disposed in front of the development unit 21 along a nearly horizontal direction; the photoreceptor unit 22 includes a photoreceptor 27 and a charger 28. The photoreceptor 27 may touch the development roller 26 in the development unit 21. By employing this kind of structure, the toner carried on the development roller 26 may be transferred to the surface of the photoreceptor 27 so as to form an electrostatic latent image; then the electrostatic latent image is developed as a toner image. The charger 28 is located over and before the photoreceptor 27, and is configured to charge the surface of the photoreceptor 27. In particular, the photoreceptor 27 adopts a photoconductive drum serving as an instance. The photoconductive drum has a cylindrical drum shape, and is made in a manner of covering a drum main body on a metal drum axis. The drum main body is formed by a positively-charged polycarbonate series photosensitive layer on the outermost layer. The photoreceptor 27 may rotate with respect to the metal drum axis, and the metal drum axis extends along a right-to-left direction as shown in the drawings (i.e., a direction perpendicular to a flow direction of a recording medium (for example, the recording paper 4)).

The photoreceptor unit 22 further includes a cleaning component 30. The cleaning component 30 is located over and before the photoreceptor 27. A first end of the cleaning component 30 (i.e., the lower end shown in FIG. 2) touches the outer surface of the photoreceptor 27. After the toner image formed on the outer surface of the photoreceptor 27 is transferred to the recording medium, the toner remaining on the photoreceptor 27 (that was not transferred to the recording medium) is removed by the first end of the cleaning component 30 to serve as waste toner. The removed waste toner (i.e., the toner that was not transferred to the recording medium) is collected into the waste toner collecting container 23 as the photoreceptor 27 rotates.

The waste toner collecting container 23 is located in front of the photoreceptor unit 27 along a nearly horizontal direction, and is fixedly connected to the assembly of the development unit 21 and photoreceptor unit 22. In particular, as shown in FIG. 2, when the waste toner collecting container 23 is fixedly connected to the assembly, the waste toner may enter the waste toner collecting container 23 via a waste toner collecting inlet 234 located below and after the waste toner collecting container 23 as the photoreceptor 27 rotates. Furthermore, as the photoreceptor 27 continues to rotate, the waste toner in the waste toner collecting container 23 is piled up gradually.

Here it should be noted that it is easy to understand for those people skilled in the art that it is possible to adopt a proper conventional connecting means to let the waste toner collecting container 23 be fixedly connected to the assembly of the development unit 21 and the photoreceptor unit 22. The connecting means may be, for example, a screw-in connecting means or a snap-on connecting means. In addition, the waste toner collecting container 23 may even be integrally formed together with the assembly of the development unit 21 and the photoreceptor unit 22.

As shown in FIG. 3, the assembly of the development unit 21 and the photoreceptor unit 22 may further include a drive transmitting mechanism 29. The drive transmitting mechanism 29 is disposed on the side of the assembly along the axial direction of the photoreceptor 27 (i.e., the right-to-left direction shown in FIG. 3), and is configured to be driven so as to drive the respective components in the assembly.

In particular, as shown in FIG. 3, the drive transmitting mechanism 29 is disposed on the right side of the assembly, and includes a pair of coaxial gears and a gear driven chain. The pair of coaxial gears may receive a driving force from a drive motor of the printer 1. The gear driven chain is disposed on the same side of the assembly, and is used for driving the respective components in the assembly. The gear driven chain may include, for example, a driving gear for the development unit 21, a driving gear for a mixer in the toner cartridge 24, and a driving gear for the photoreceptor 27 in the photoreceptor unit 22. The pair of coaxial gears includes a driven gear that may rotate by receiving the driving force from the drive motor of the printer 1; and a driving gear that may synchronously rotate together with the driven gear, and may further drive the respective components in the assembly. In particular, the driving force from the drive motor of the printer 1 is transmitted to the driven gear so as to cause the driven gear to rotate; as the driven gear rotates, the driving gear coaxial with the driven gear is driven so as to carry out the synchronous rotation. The driving gear coaxial with the driven gear is engaged with the gear driven chain disposed on the same side of the assembly for driving the respective components in the assembly (as described above, the gear driven chain may include, for example, a driving gear for the development unit 21, a driving gear for a mixer in the toner cartridge 24, and a driving gear for the photoreceptor 27 in the photoreceptor unit 22). As a result, as the driving gear coaxial with the driven gear rotates, the respective gears in the gear driven chain are driven so as to rotate; in this way, the respective components in the assembly are driven.

As described above, the drive transmitting mechanism 29 is achieved by adopting the pair of coaxial gears and the gear driven chain; however, it should be noted that the present invention is not limited to this. Those people skilled in the art may select a proper formation of the drive transmitting mechanism 29 on the basis of actual use and design demands. In other words, as long as the drive transmitting mechanism 29 is disposed on the side of the assembly, and may receive the driving force from the drive motor of the printer 1 so as to drive the respective components in the assembly, it is okay.

In addition, the printer 1 may further include a transfer roller (not shown in the drawings); the transfer roller may be located below the photoreceptor 27, as shown in FIG. 1. While the printer 1 works, the photoreceptor 27 and the transfer roller cooperate so as to receive the recording medium, and to transfer the toner image generated on the surface of the photoreceptor 27 to the recording medium.

<Structure of Waste Toner Collecting Container 23>

Figure 5:
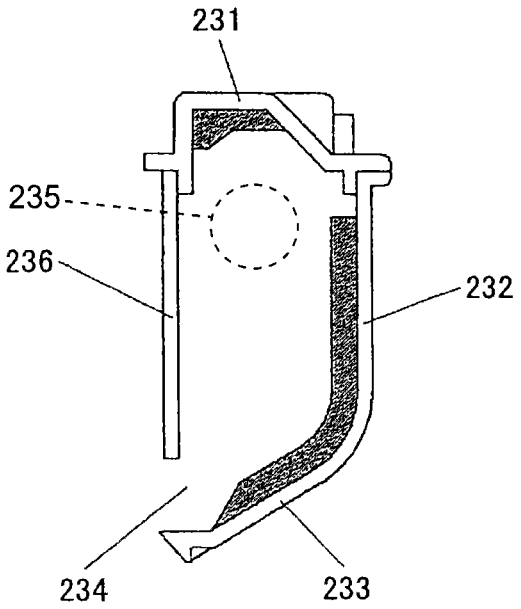
FIG. 5 is a cross-section diagram of a waste toner collecting container in the printer shown in FIG. 1 along a direction perpendicular to the axial direction of a photoreceptor in the printer.

FIG. 5 is a cross-section diagram of the waste toner collecting container 23 in the printer 1 shown in FIG. 1 along a direction perpendicular to the axial direction of the photoreceptor 27 in the printer 1.

Figure 6:
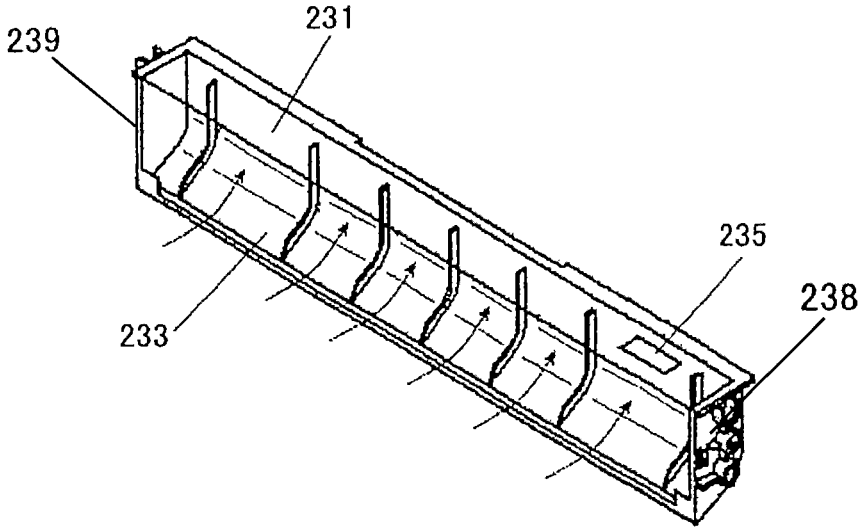
FIG. 6 illustrates flow of waste toner when the waste toner is collected into the waste toner collecting container in the printer shown in FIG. 1, wherein, arrows indicate the flow direction when the waste toner enters the waste toner collecting container via a waste toner collecting inlet.

FIG. 6 illustrates flow of the waste toner when it is collected into the waste toner collecting container 23 in the printer 1 shown in FIG. 1, wherein, arrows indicate the flow direction when the waste toner enters the waste toner collecting container 23 via the waste toner collecting inlet 234.

Figure 7:
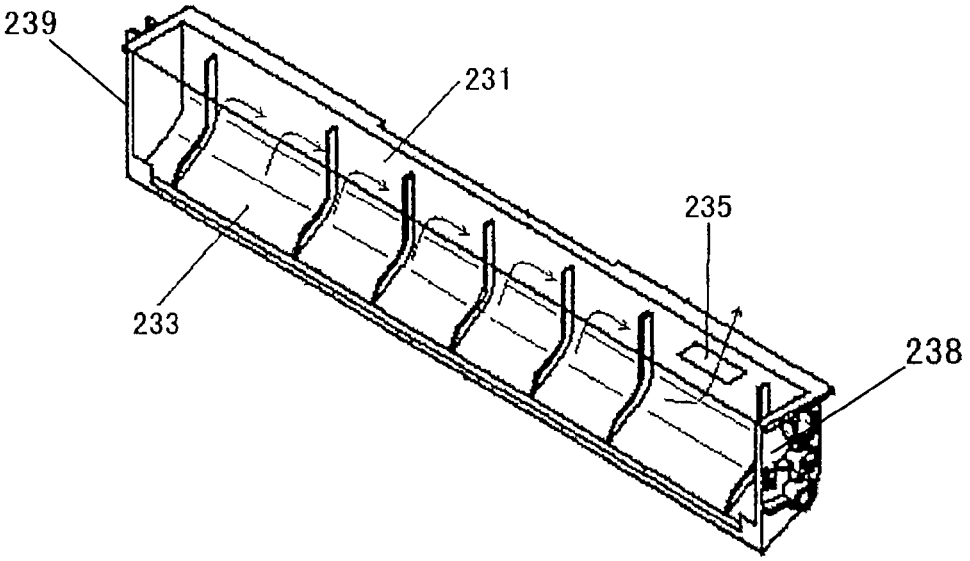
FIG. 7 illustrates flow of waste toner when the waste toner is discharged from the waste toner collecting container in the printer shown in FIG. 1, wherein, arrows indicate the flow directions when the waste toner collecting container discharges the waste toner.

FIG. 7 illustrates flow of the waste toner when it is discharged from the waste toner collecting container 23 in the printer 1 shown in FIG. 1, wherein, arrows indicate the flow direction when the waste toner collecting container 23 discharges the waste toner.

As shown in FIGS. 2 to 5, the waste toner collecting container 23 located in front of the process unit 9 has a box-like shape, and comprises a top wall 231 far away from the photoreceptor 27, a first side wall 232 facing the photoreceptor 27, a bottom wall 233 obliquely extending downward the photoreceptor 27 from the first side wall 232, and a second side wall 236 approaching the photoreceptor 27. The first side wall 232 and the second side wall 236 are positioned between a first end wall 238 and a second end wall 239 along a longitudinal direction of the waste toner collecting container. The waste toner collecting inlet 234 is disposed at a position of the bottom wall 233, approaching the photoreceptor 27. In a case where the waste toner collecting container 23 is fixedly connected to the assembly, as the photoreceptor 27 rotates, the waste toner enters the waste toner collecting container 23 via the waste toner collecting inlet 234. Furthermore, as the photoreceptor continues to rotate, the waste toner in the waste toner collecting container 23 is piled up gradually, and finally the waste toner collecting container 23 is filled with the waste toner.

In addition, as shown in FIGS. 5 to 7, plural reinforcing ribs are disposed on the inner surface of at least one peripheral wall of the waste toner collecting container. In particular, all the plural reinforcing ribs disposed on the inner surface of the peripheral wall of the waste toner collecting container 23 extend along a direction perpendicular to the axial direction of the photoreceptor 27. By adopting this kind of structure, as shown in FIG. 6, when the waste toner enters the waste toner collecting container 23 via the waste toner collecting inlet 234 as the photoreceptor 27 rotates, the waste toner between two adjacent reinforcing ribs may flow along the extending direction of the reinforcing ribs. In this way, the direction of the waste toner flowing into the waste toner collecting container 23 and the direction of the waste toner flowing within the waste toner collecting container 23 are the same. As a result, it is possible to dramatically improve the flowability of the waste toner, and to ensure that the waste toner flows fluently when it flows into the waste toner collecting container 23 and when it flows within the waste toner collecting container 23, so that delays and pileups may not occur while the waste toner flows into or within the waste toner collecting container 23.

By using this kind of structure, it is possible to largely increase the overall strength of the waste toner collecting container 23 so that when the waste toner is discharged, if necessary, the user may properly hit the peripheral wall of the waste toner collecting container 23 so as to easily cause the waste toner attached to the inner surface of the peripheral wall of the waste toner collecting container 23 to flow out. In this way, it is possible to more sufficiently discharge the waste toner, and the damage caused by hitting the waste toner collecting container 23 may be avoided too. Furthermore, by letting the plural reinforcing ribs extend along the direction perpendicular to the axial direction of the photoreceptor, it is ensured that when the waste toner enters the waste toner collecting container 23 and when the waste toner flows within the waste toner collecting container 23, it may flow fluently, i.e., delays and pileups may not occur while the waste toner flows into or within the waste toner collecting container 23.

Furthermore, as shown in FIG. 2, plural reinforcing ribs may be disposed on the top wall 231 of the waste toner container 23 as well as the inner surface of the first side wall 232 of the waste toner collecting container 23, facing the photoreceptor 27.

By applying this kind of structure, it is possible not only to effectively increase the overall strength of the waste toner collecting container 23 but also to fluently discharge the waste toner therein. In particular, since the plural reinforcing ribs are not disposed at least on the inner surface of the second side wall 236 of the waste toner collecting container 23, approaching of the photoreceptor 27, when the waste toner in the waste toner collecting container 23 is discharged, the waste toner may fluently flow along the inner surface of the second side wall 236 of the waste toner collecting container 23. In this way, the waste toner in the waste toner collecting container 23 may be fluently discharged without any influence of the reinforcing ribs.

In addition, in order to further improve the structural rigidity of the waste toner collecting container 23 and to increase the flowability of the waste toner in the waste toner collecting container 23, at least one reinforcing rib may be disposed on the inner surface of the bottom wall 233 obliquely extending downward the photoreceptor 27 from the first side wall 232. However, the present invention is not limited to this. Those people skilled in the art should easily understand that as long as the structural rigidity of the waste toner collecting container 23 may be improved, and the flowability of the waste toner in the waste toner collecting container 23 may be ensured, the reinforcing ribs may be disposed on the inner surface of at least one peripheral wall according to actual use and design demands.

Here it should be noted that on the cross section vertical to the axial direction of the photoreceptor 27, the ratio of the distribution area of the plural reinforcing ribs to the peripheral wall surrounded area of the waste toner collecting container 23 is 10% to 50%.

In particular, as shown in FIG. 5, on the cross section perpendicular to the axial direction of the photoreceptor 27, the ratio of the distribution area of the reinforcing ribs disposed on the inner surfaces of the top wall 231, the first side wall 232, and the bottom wall 233 of the waste toner collecting container 23 to the peripheral wall surrounded area of the waste toner collecting container 23 is 19%.

Here the distribution area refers to the sum of the areas of the reinforcing ribs disposed on the inner surfaces of the peripheral walls of the waste toner collecting container 23 on the cross section vertical to the axial direction of the photoreceptor 27, as the shadow area in FIG. 5 shows. The peripheral wall surrounded area of the waste toner collecting container 23 refers to the area surrounded by the top wall 231, the first side wall 232, the bottom wall 233, and the second side wall 236, as shown in FIG. 5.

By employing the above described structure, it is possible not only to ensure that the waste toner may fluently flow into the waste toner collecting container 23 but also to ensure that the waste toner may be fluently discharged from the waste toner collecting container 23. Aside from this, as long as the ratio of the distributional area of the reinforcing ribs to the peripheral wall surrounded area of the waste toner collecting container 23 is 10% to 50%, on the cross section vertical to the axial direction of the photoreceptor 27, it is possible to achieve the above described technical effects.

On the contrary, in a case where the ratio of the distributional area of the reinforcing ribs to the peripheral wall surrounded area of the waste toner collecting container 23 is less than 10%, then the reinforcing ribs may not carry out reinforcement with regard to the overall strength of the waste toner collecting container 23. In this case, when the user hits the waste toner collecting container 23, a deformation thereof may not be avoided; as a result, the positioning accuracy between the waste toner collecting container 23 and other components of the printer 1 may be badly influenced. If the distributional area of the reinforcing ribs is too small, then the reinforcing ribs may not carry out guidance with regard to the flow of the waste toner when it flows into the waste toner collecting container 23 via the waste toner collecting inlet 234. As a result, the waste toner may not fluently flow into the waste toner collecting container 23, and the reinforcing ribs may not achieve the function of guiding the flow of the waste toner when it flows into or within in the waste toner collecting container 23.

Moreover, in a case where the ratio of the distributional area of the reinforcing ribs to the peripheral wall surrounded area of the waste toner collecting container 23 is greater than 50%, since the distributional area is too large, when the waste toner is discharged from the waste toner collecting container 23, the reinforcing ribs may dramatically disrupt the flow of the waste toner. As a result, the waste toner may not be fluently discharged from the waste toner collecting container 23.

In addition, as shown in FIGS. 3 and 4, the waste toner collecting container 23 may further comprise a waste toner discharging outlet 235. The waste toner discharging outlet 235 is disposed at a position of the top wall 231 of the waste toner collecting container 23, far away from the photoreceptor 27, and is disposed on at least one end of the top wall 231 along the longitudinal direction of the waste toner collecting container 23 which is parallel to the axial direction of the photoreceptor 27 (i.e., the right-to-left direction shown in drawings).

In particular, the waste toner discharging outlet 235 is disposed on one end of the top wall 231 along the axial direction of the photoreceptor 27 and the longitudinal direction of the waste toner collecting container 23 (as shown in FIGS. 3 and 4, the waste toner discharging outlet 235 is located at the left end of the top wall 231). However, the present invention is not limited to this. In other words, the waste toner discharging outlet 235 may be disposed on another end of the top wall 231, or two waste toner discharging outlets 235 may be disposed on two ends of the top wall 231, respectively.

Here it should be noted that although the waste toner discharging outlet 235 is disposed at the position of the top wall 231 of the waste toner collecting container 23, far away from the photoreceptor 27 in FIG. 5, the present invention is not limited to this. Those people skilled in the art should easily understand that the waste toner discharging outlet 235 may be disposed on any one of the peripheral walls of the waste toner collecting container 23 according to actual use and design demands. For example, the waste toner discharging outlet 235 may be disposed on the first side wall 232 far away from the photoreceptor 27, or may be disposed on one of the first end wall 238 or the second end wall 239 of the waste toner collecting container 23 which is along the longitudinal direction that is parallel to the axial direction of the photoreceptor 27.

By using the above described structure, when the waste toner collecting container 23 is full with the waste toner, the user may first remove a cover (not shown in the drawings) of the waste toner discharging outlet 235, then entirely rotate the waste toner collecting container 23 so as to cause the waste toner discharging outlet 235 to be located at the bottommost of the waste toner collecting container 23. At this time, due to gravity, the waste toner in the waste toner collecting container 23 may accumulate near the waste toner discharging outlet 235, and may flow out from the waste toner discharging outlet 235. In this way, it is possible to sufficiently discharge the waste toner from the waste toner collecting container 23, improve the operational convenience, and increase the reusability of the process unit.

Furthermore, as shown in FIGS. 3 and 4, the waste toner discharging outlet 235 is nearly rectangle-shaped; however, the present invention is not limited to this. Those people skilled in the art may render the waste toner discharging outlet 235 circle-shaped, etc.

As shown in FIGS. 3 and 4, the waste toner discharging outlet 235 is located at one end of the top wall 231 of the waste toner collecting container 23 (i.e., the left end in the drawings), far away from the side of the drive transmitting mechanism 29 (i.e., the right side in the drawings).

In this kind of structure, the drive transmitting mechanism 29 used for driving the respective component in the assembly is disposed on the side of the assembly, and the waste toner discharging outlet 235 is located at the end of the top wall 231 of the waste toner collecting container 23, far away from the side of the drive transmitting mechanism 29. As a result, by letting the waste toner discharging outlet 235 be far away from the drive transmitting mechanism 29, when the waste toner in the waste toner collecting container 23 is discharged, the discharged waste toner may not attach to the drive transmitting mechanism 29 even when the waste toner scatters. In this way, it is possible to avoid the bad influence applied to the connection accuracy of the drive transmitting mechanism 29, caused by the attached waste toner thereof, and to improve the reusability of the assembly and the waste toner collecting container 23.

In addition, as shown in FIG. 4, a protrusion 237 is disposed on the outer surface of the top wall 231 of the waste toner collecting container 23; the height of the protrusion 237 from the outer surface of the top wall 231 is T. The waste toner discharging outlet 235 is disposed on the protrusion 237. In particular, as shown in FIG. 4, the protrusion 237 is formed on the outer surface of the top wall 231 of the waste toner collecting container 23; the protrusion 237 extends on the whole outer surface of the top wall 231 along the axial direction of the photoreceptor 27 and the longitudinal direction of the waste toner collecting container 23. Furthermore, as shown in FIG. 4, the waste toner discharging outlet 235 is set on the protrusion 237, and is located at one end of the waste toner collecting container 23 along the axial direction of the photoreceptor 27.

By using this kind of structure, it is possible to let the waste toner discharging outlet 235 be farther away from the drive transmitting mechanism 29. In this way, when the waste toner is discharged, the drive transmitting mechanism 29 may not be polluted by the scattered waste toner. Moreover, by disposing the protrusion 237, it is possible not only to achieve the above described technical effects but also to further increase the volume of the waste toner collecting container 23.

Here it should be noted that although the protrusion 237 is disposed as described above, the present invention is not limited to this. In other words, as long as the waste toner discharging outlet 235 is able to be disposed on the protrusion 237, the protrusion 237 may be disposed, for example, only on the end of the top wall 231 along the axial direction of the photoreceptor 27.

In addition, as described above, the height of the protrusion 237 from the outer surface of the top wall 231 of the waste toner collecting container 23 is T, as shown in FIG. 4. In a case where the height T is too large, the overall rigidity of the waste toner collecting container 23 decreases, and the difficulty of manufacturing the waste toner collecting container 23 increases. On the other hand, in a case where the height T is too small, it is impossible to achieve the good technical effects. Therefore, as for a well-used all-in-one laser printer in the conventional techniques, the height T is preferred to be 3 to 8 mm. By this, it is possible to guarantee the overall rigidity of the waste toner collecting container 23, to let the waste toner collecting container 23 be convenient for processing, and to obtain the good technical effects.

Figure 8:
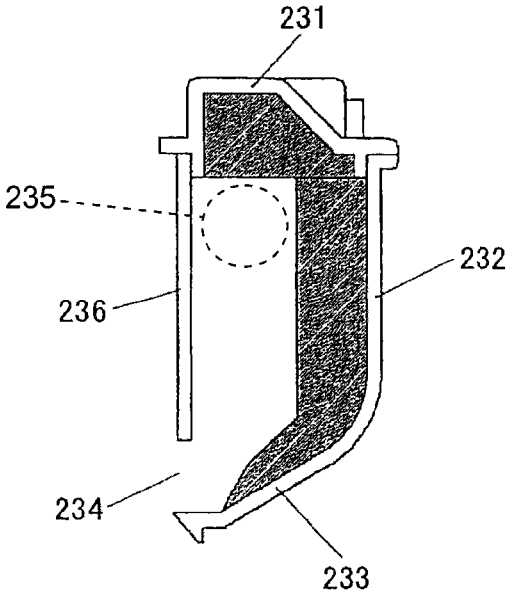
FIG. 8 is a cross-section diagram of a waste toner collecting container along a direction perpendicular to the axial direction of a photoreceptor, according to a second embodiment of the present invention.

In what follows, a second embodiment of the present invention is concretely described by referring to FIG. 8.

FIG. 8 is a cross-section diagram of a waste toner collecting container along a direction perpendicular to the axial direction of a photoreceptor, according to the second embodiment of the present invention.

Here it should be noted that in the second embodiment, constructional elements being the same with or similar to those in the first embodiment are given the same symbols, and repeated explanations for the constructional elements are omitted.

As shown in FIG. 8, in the second embodiment, the difference from the first embodiment is such that on the cross section vertical to the axial direction of the photoreceptor 27, the ratio of the distributional area of plural reinforcing ribs to the peripheral wall surrounded area of the waste toner collecting container 23 is 50%.

As shown in FIG. 8, the ratio of the distributional area of the plural reinforcing ribs to the peripheral wall surrounded area of the waste toner collecting container 23 is 50%. By adopting this kind of structure, when waste toner flows into the waste toner collecting container 23 via a waste toner collecting inlet 234 as the photoreceptor 27 rotates, the waste toner between two adjacent reinforcing ribs may flow very fluently along the extending direction of the reinforcing ribs. In this way, the direction of the waste toner flowing into the waste toner collecting container 23 and the direction of the waste toner flowing within the waste toner collecting container 23 are the same. As a result, it is possible to dramatically improve the flowability of the waste toner, and to ensure that the waste toner flows fluently when it enters the waste toner collecting container 23 and when it flows within the waste toner collecting container 23, so that delays and pileups may not occur while the waste toner flows into or within the waste toner collecting container 23.

Furthermore, as shown in FIG. 8, since the ratio of the distributional area of the plural reinforcing ribs to the peripheral wall surrounded area of the waste toner collecting container 23 is 50%, when the waste toner is discharged from the waste toner collecting container 23, the plural reinforcing ribs may slightly disturb the flow of the waste toner. However, once the ratio of the distributional area of the plural reinforcing ribs to the peripheral wall surrounded area of the waste toner collecting container 23 is greater than 50%, the plural reinforcing ribs may dramatically disturb the flow of the waste toner flowing out from the waste toner collecting container 23, and the waste toner in the waste toner collecting container 23 may not be fluently discharged.

In addition, the present invention also relates to a process unit used in the image forming device. The process unit includes an assembly of a development unit and a photoreceptor unit as well as the waste toner collecting container described in the above embodiments.

While the waste toner collecting container used in the image forming device and the process unit including the waste toner collecting container are described with reference to the specific embodiments chosen for purpose of illustration, it should be apparent that the present invention is not limited to these embodiments, but numerous modifications could be made thereto by those people skilled in the art without departing from the basic concept and scope of the present invention.

The present application is based on Chinese Priority Patent Application No. 201110247357.6 and Chinese Priority Utility Model Application No. 201120313918.3 filed on Aug. 25, 2011, the entire contents of them are hereby incorporated by reference.

What is claimed is:

1. A waste toner collecting container fixedly connected to an assembly of a development unit and a photoreceptor unit, the waste toner collecting container comprising:

a first wall;

a second wall;

a bottom wall that extends obliquely downward relative to the first wall and the second wall to a waste toner collecting inlet through which waste toner enters the waste toner collecting container as the photoreceptor rotates, the waste toner collecting inlet being below the second wall;

a top wall mounted on top of the first wall and the second wall;

plural reinforcing ribs spaced apart along an axial direction of the photoreceptor, each of the plural reinforcing ribs including first and second surface portions perpendicular to the axial direction, the first and second surface portions being on opposite sides of each of the plural reinforcing ribs, each of the plural reinforcing ribs protruding from an inner surface of the bottom wall and an inner surface of the first wall to form a concave profile that opens to an inner surface of the second wall, the inner surface of the first wall facing the photoreceptor unit and the development unit; and a waste toner discharging outlet formed in the top wall at an end of the top wall along the axial direction of the photoreceptor, the plural reinforcing ribs being spaced apart from the waste toner discharging outlet along the axial direction, wherein the development unit is configured to supply toner to the photoreceptor in the photoreceptor unit, wherein the photoreceptor unit is configured to form a toner image on an outer surface of the photoreceptor and includes a cleaning component that removes waste toner that remains on the outer surface of the photoreceptor after the toner image is transferred to a recording medium, and wherein the waste toner collects between the first wall and the second wall and is discharged from the collecting container through the top wall via the waste toner discharging outlet.

2. The waste toner collecting container according to claim 1, wherein the assembly includes a drive transmitting mechanism positioned on a side of the assembly along the axial direction of the photoreceptor and configured to drive respective components of the assembly, and wherein the end of the top wall where the waste toner discharging outlet is formed, is on a side of the assembly along the axial direction of the photoreceptor opposite to the side of the assembly where the drive transmitting mechanism is positioned.

3. The waste toner collecting container according to claim 1, wherein a ratio of a distributional area of the first and second surface portions of the plural reinforcing ribs to a peripheral wall surrounded area of the waste toner collecting container on a cross section perpendicular to the axial direction of the photoreceptor is 10% to 50%.

4. The waste toner collecting container according to claim 1, wherein the top wall includes a protrusion and the waste toner discharging outlet is formed in the protrusion.

5. A process unit comprising:

an assembly of a development unit and a photoreceptor unit; and the waste toner collecting container according to claim 1.

6. The process unit according to claim 5, wherein a toner filling inlet is disposed at a position on a top wall of the process unit.

7. An image forming device comprising the process unit according to claim 5.

8. The waste toner collecting container according to claim 1, further comprising a waste toner collecting inlet, wherein the at least one of the inner surface of the bottom wall and the inner surface of the first wall forms at least a portion of an inner surface of at least one peripheral wall of the waste toner collecting container, and the inner surface of the at least one peripheral wall guides a flow of the waste toner within the waste toner collecting container in a direction that is the same as a direction of a flow of the waste toner through the waste toner collecting inlet into the waste toner collecting container.

9. The waste toner collecting container according to claim 8, wherein the plural reinforcing ribs extend on the inner surface of the at least one peripheral wall in a direction perpendicular to the axial direction of the photoreceptor, and wherein the inner surface of the at least one peripheral wall and the plural reinforcing ribs guide the flow of the waste toner within the waste toner collecting container in the direction perpendicular to the axial direction of the photoreceptor.

10. The waste toner collecting container according to claim 8, wherein the bottom wall provides the at least one peripheral wall.

11. The waste toner collecting container according to claim 1, wherein the plural reinforcing ribs are configured to cause the waste toner to flow from a first side of the top wall to a second side of the top wall opposite to the first side and out of the waste toner collecting container through the waste toner discharging outlet.

12. The waste toner collecting container according to claim 1, wherein the top wall includes an inner surface, a first surface that abuts a surface of the first wall along a longitudinal axis of the top wall, and a second surface that abuts a surface of the second wall along the longitudinal axis of the top wall, and wherein the first surface and the second surface of the top wall are positioned on opposite sides of the inner surface of the top wall.

13. The waste toner collecting container according to claim 1, wherein the plural reinforcing ribs support a wall of the waste toner collecting container including an outer surface that faces a direction opposite to a direction facing the photoreceptor.

14. A waste toner collecting container comprising:

a first end wall;

a second end wall;

a first wall positioned between the first end wall and the second end wall along a longitudinal direction of the waste toner collecting container;

a second wall positioned between the first end wall and the second end wall along the longitudinal direction of the waste toner collecting container;

a top wall mounted on top of the first wall and the second wall;

a bottom wall that extends obliquely downward relative to the first wall and the second wall to a waste toner collecting inlet below the second wall;

plural reinforcing ribs protruding from an inner surface of the waste toner collecting container below an inner surface of the top wall and extending in a substantially vertical direction and obliquely toward the waste toner collecting inlet to form a concave profile that opens to an inner surface of the second wall, each of the plural reinforcing ribs including first and second surface portions perpendicular to the longitudinal direction of the waste toner collecting container, the first and second surface portions being on opposite sides of each of the plural reinforcing ribs; and a waste toner discharging outlet formed in at least one peripheral wall portion at an end of the waste toner collecting container along a longitudinal direction of the waste toner collecting container, the plural reinforcing ribs being spaced apart from the waste toner discharging outlet along the axial direction, wherein a development unit supplies toner to a photoreceptor in a photoreceptor unit and the waste toner collecting container receives waste toner from the photoreceptor unit, and wherein the waste toner collecting container collects waste toner between the first wall and the second wall and discharges the waste toner through the top wall via the waste toner discharging outlet.

15. The waste toner collecting container according to claim 1, wherein the inside surface of the second wall is free of reinforcing ribs.

16. The waste toner collecting container according to claim 14, wherein a ratio of a distributional area of the first and second surface portions of the plural reinforcing ribs to a peripheral wall surrounded area of the waste toner collecting container on a cross section perpendicular to the axial direction of the photoreceptor is 10% to 50%.

17. The waste toner collecting container according to claim 14, wherein the inside surface of the second wall is free of reinforcing ribs.

18. The waste toner collecting container according to claim 1, wherein the ratio of the distributional area of the first and second surface portions of the plural reinforcing ribs to the peripheral wall surrounded area of the waste toner collecting container on the cross section perpendicular to the axial direction of the photoreceptor is 19%.

19. The waste toner collecting container according to claim 14, wherein the ratio of the distributional area of the first and second surface portions of the plural reinforcing ribs to the peripheral wall surrounded area of the waste toner collecting container on the cross section perpendicular to the axial direction of the photoreceptor is 19%.

* * * * *